United States Patent [19]

Kucharczyk

[11] 4,173,175

[45] Nov. 6, 1979

[54] AIR VENT

[75] Inventor: Eckhard Kucharczyk, Netphen, Fed. Rep. of Germany

[73] Assignee: Siegenia-Frank KG, Siegen, Fed. Rep. of Germany

[21] Appl. No.: 897,151

[22] Filed: Apr. 17, 1978

[30] Foreign Application Priority Data

Feb. 1, 1978 [DE] Fed. Rep. of Germany ..... 2718167

[51] Int. Cl.[2] ..... F24F 13/08

[52] U.S. Cl. ..... 98/41 SV; 98/41 R; 49/95

[58] Field of Search ..... 98/41 R, 41 SV; 49/95; 137/601; 251/158

[56] References Cited

U.S. PATENT DOCUMENTS

| | | | |
|---|---|---|---|
| 2,056,224 | 10/1936 | Dart | 49/213 |
| 2,525,371 | 10/1950 | Reynolds, Sr. | 98/41 SV |
| 2,717,064 | 9/1955 | Hock | 49/394 |
| 2,792,771 | 5/1957 | Burwen | 98/41 SV |
| 2,814,242 | 11/1957 | Marini et al. | 98/41 SV |
| 2,936,692 | 5/1960 | White | 98/41 SV |
| 3,528,359 | 9/1970 | Sand | 98/41 R |
| 3,752,223 | 8/1973 | Finch | 98/41 SV |

FOREIGN PATENT DOCUMENTS

| | | | |
|---|---|---|---|
| 1249489 | 9/1967 | Fed. Rep. of Germany | 98/41 R |
| 2208289 | 10/1972 | Fed. Rep. of Germany | 98/41 R |
| 7504175 | 6/1975 | Fed. Rep. of Germany | 98/41 R |
| 2608053 | 9/1977 | Fed. Rep. of Germany | 98/41 R |

*Primary Examiner*—Henry C. Yuen

*Attorney, Agent, or Firm*—Norman S. Blodgett; Gerry A. Blodgett

[57] ABSTRACT

An air vent having a detachable front plate provided with apertures, a closure plate behind the front plate, an operating device for moving the closure plate toward and away from the front plate for blocking and unblocking and apertures, the operating device being connected to the closure plate by means of a slot and pin connection which allows the closure plate to be removed independently of the operating means.

6 Claims, 4 Drawing Figures

AIR VENT

BACKGROUND OF THE INVENTION

The invention is generally concerned with a ventilation device for rooms consisting of a stationery front plate having apertures or openings and a closure plate arranged behind it. The closure plate is movable transversely to the plane of the closure plate and to the plane of the front plate wherein the closure plate is effective for blocking the apertures of the front plate when it abuts the front plate but allows air to enter the apertures, or openings, of the front plate when the front plate and closure plate are separated.

In prior art devices such as that shown in German Pat. No. 1,249,489, the front plate is directly mounted in front of the air opening of a window or a door. In the event that the air opening has to be freed, for example for the purpose of cleaning, the ventilation device, including the operating devices for the closure plate, has to be removed. For this purpose, it is also necessary to remove the operating devices, etc. mounted to the door or window frames.

It is also known, as for example in German Pat. No. 7,504,175, to provide a device for ventilation of rooms where the inside thereof is made accessible by means of a flap cover for the purpose of cleaning. However, even in this design, which includes an apertured front plate and a sliding closure plate, it is necessary to remove the operating device for the slide plate. These and other difficulties experienced by the prior art devices have been obviated by the present invention.

It is, therefore, an outstanding object of the invention to provide an air vent device having improved mounting features for the various operating elements to facilitate assembly and disassembly for cleaning the device.

Another object of the invention is the provision of an air vent device in which various elements are easily fabricated A further object of the invention is the provision of an air vent device in which various elements are made from extruded sheet stock of metal or plastic.

With these and other objects in view, as will be apparent to those skilled in the art, the invention resides in the combination of parts set forth in the specification and covered by the claims appended hereto.

SUMMARY OF THE INVENTION

In general, the invention consists of an air vent device of the type which is equipped with an operating device comprising adjustable push rods which move longitudinally within guides and parallel to the longitudinal edges of the front plate. Flanges extending from the front enclosure plates are positioned adjacent to the push rods and are equipped with adjusting means consisting of slanted slots distributed over the whole length of the push rods and flanges, and pins extending into the slots for guiding the closure plate and its transverse movements with respect to the front plate. The guides for the push rods are arranged inside of a frame flange which holds the removable front plate. The slanted slots in which the pins are slidingly guided are provided with openings at the edge of the flange in which they are located to allow egress of the pins from the slots. This makes is possible to open the air vent by loosening the front plate and removing it and the closure plate without removing the push rods and the pins associated with the push rods.

Another advantage of the present device is that the important elements, namely the front plate, closure plate and push rods can be simply fabricated from extruded sheet stock of light metal or plastic. It is only necessary to cut desired lengths from the stock material and fit them together in cooperating relationship. The elements which provide for the transverse movement of the closure plate are evenly distributed over the whole length of the air vent device which provides an excellent seal between the closure plate and the front plae when these two plates abut at the time that the closure plate is moved to its closed position against the front plate.

Another feature of the invention is the provision of offset horizontal edge bars extending from the frame. The edge bars are provided with guides for the push rods and elongated longitudinal grooves. The front plate is provided with horizontal flanges which overlap the edge bars. One of the front plate flanges has a vertically extending lip which engages the groove in the corresponding edge bar and the other front plate flange is equipped with fastening members, for example set screws, which extend into the groove of the corresponding edge bar.

Finally, an important characteristic of this invention provides that the two edge bars of the frame are quipped with additional grooves, for example, C-shaped undercut grooves, for receiving gasket elements, for example, H-shaped profile pressed-on lip gaskets, and the corresponding flanges of the plate contain corresponding gasket-support areas. It is also preferred that holding devices be provided which allow the closure plate to move transversely of the front plate and yet tie the front plate and closure plate together so that they may be removed as a unit. On the other hand, the front plate and closure plate may be mounted separately and be handled independently from each other.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
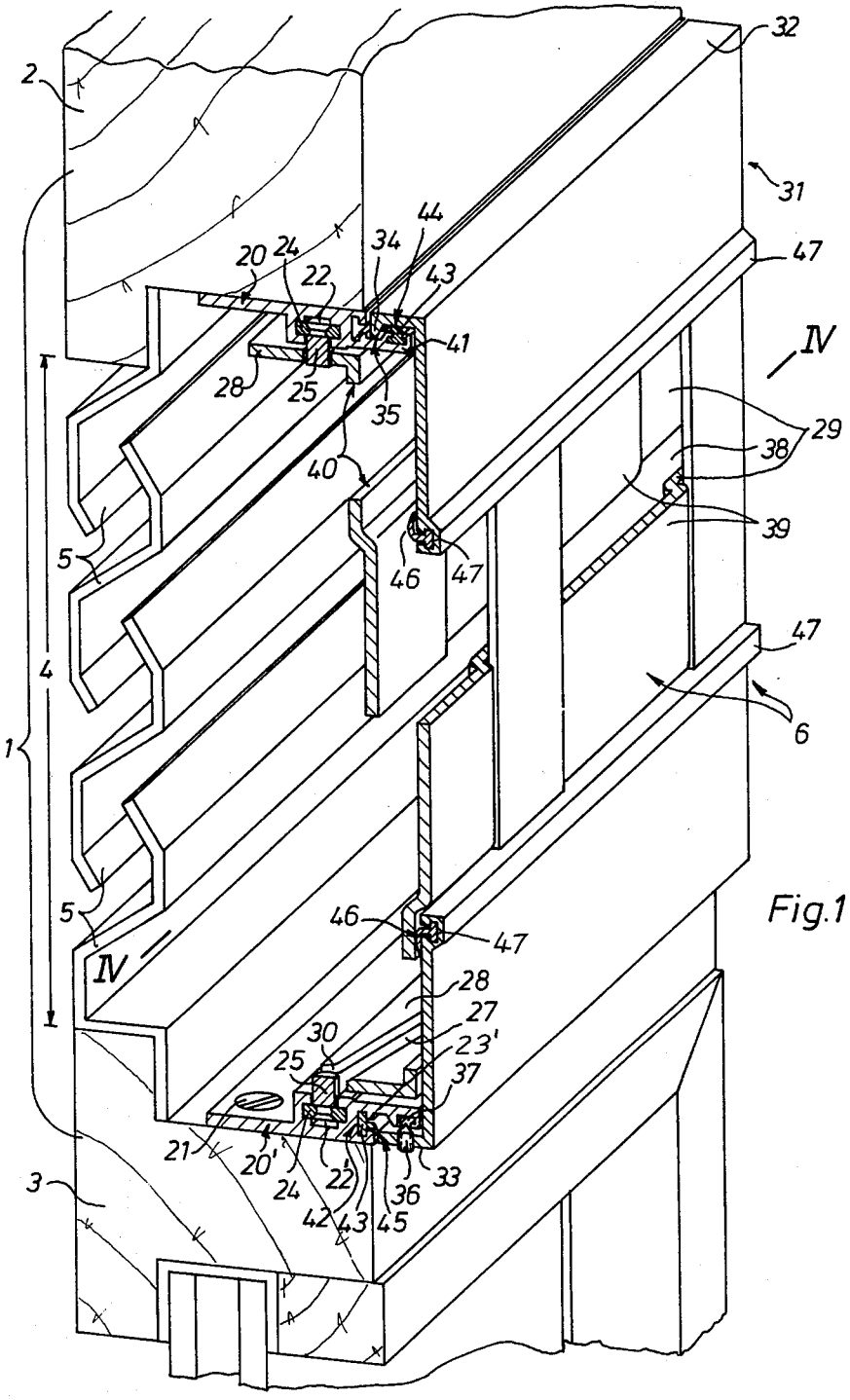
FIG. 1 is a perspective view of the invention applied to a window frame with portions broken away.

Referring first to FIG. 1, the invention is shown applied to a window frame indicated at 1 which includes a vent slot 4 located between an upper frame strip 2 and a lower abutment 3. Spaced overlapping weather strips 5 are arranged along the outside of the vent slot 4.

The air vent of the present invention is generally indicated by the reference numeral 6 and is located on the inside of the window casing. Air vent 6 comprises a pair of elongated plates 20 and 20' fastened respectively to the under side of strut 2 and the upper recessed surface of abutment 3 by means such as screws 21. Plates 20 and 20' have elongated T-shaped or dove-tailed grooves 22 and 22', respectively, provided with elongated opening 26 and 26', respectively. The inside of plates 20 and 20' have integrally formed and offset edge bars 23 and 23', respectively, which include grooves 42 and 37, respectively. The openings, 26 and 26' face each other and open into the vent slot 4 while the openings of the grooves 37 and 42 face away from vent slot 4.

Push rods 24 and slidably mounted within grooves 22 and 22' and include pins 25 which extend through the opening 26 and 26'. The push rods 24 of the upper and lower plates 20 and 20' respectively, are inter-connected so that they may be displaced in unison along their respective grooves 22 and 22'.

A closure plate, generally indicated by the reference numeral 29, is located on the inside of the vent slot 4 and has a pair of outwardly directed horizontal flanges 28 which extend toward the vent slot in overlapping relationships with the plates 20 and 20', the uppermost flange 28 being associated with the upper plate 20 and the lower-most flange 28 being associated with the lower plate 20' as shown in FIG. 1. Each flange 28 has a plurality of openings 30 along its outer edge. Each opening 30 is connected to a slot 27 which extends at an angle to the outer edge of the flange 28. Pins 25 which extend through the openings 26 also extend into slots 27.

A front plate, generally indicated by the reference numeral 31, is located on the inside of the window vent slot 4 and includes upper and lower flanges 32 and 33, respectively, which extend toward the outside of the window. When front plate 31 is properly positioned, as shown in FIG. 1, the upper and lower flanges 32 and 33 overlap, respectively, the upper and lower edge bars 23 and 23'. Upper flange 32 has a downwardly extending lip 34 which fits into a groove 35 in the upper edge bar 23. A set screw 36 extends through the lower flange 33 into the groove 37 of the lower edge bar 23'. In this manner, the front plate 31 is detachably mounted in place.

The main vertical area of front plate 31 is provided with a plurality of rectangular-shaped apertures 38. Closure plate 29 is provided along its main vertical section with a plurality of flat rectangular-shaped protuberances which are horizontally aligned with, and conform to the shape of, the apertures 38. Closure plate 29 is moved toward and away from the front plate 31 by means of the push rods 24. When the push rods 24 are moved along the T-shaped grooves 22 and 22', the pins 25 moves in slots 27, causing the closure plate 29 to move horizontally or in a transverse direction to the vertical planes of the closure plate 29 and front plate 31. This movement causes the protuberances 39 to move into and out of sealing relationship with the apertures 38. As can be seen in FIG. 1, when the pins 25 are in the portion of this slot 27 near the openings 30, closure plate 29 is in its further inward position against front plate 31 so that the protuberances 39 extend into apertures 38 in sealing relationship. Movement of pins 25 away from openings 30 causes the closure plate 29 to move toward the outside of the window away from front plate 31, thereby opening apertures 38. Additional apertures 40 are located above and below protuberances 39 and closure plate 29 to allow air to flow through the closure plate 29 from the outside of the window.

When it is desired to clean the air vent, the outer plate 31 is removed by loosening set screw 36 and lifting groove lip 34 out of groove 35. It is preferred that front plate 31 and closure plate 29 are inter-connected by special holding devices shown in German patent application No. P27 03 201.1 so that the transverse movement of front plate 31 in a direction transverse to the general vertical plane of the plate will also move closure plate 29 in the same direction, thereby disengaging the slots 27 from the pins 25 which slip out through the openings 30 and the flanges 28. It is also possible to dispense with the interconnecting holding devices and remove the plates 31 and 29 separately.

Gaskets 43 of generally H-shaped cross section are inserted in grooves 41 and 42 of the upper and lower edge bars 23 and 23', respectively. In the embodiment shown in FIG. 1, a gasket 43 is located in the groove 41 of the upper edge bar 23 and a gasket 43 is located in the groove 42 of the lower edge bar 23' for producing a sealing engagement with surface areas 44 and 45, respectively, of the upper and lower flanges 32 and 33, respectively. Additional H-gaskets 46 are located in grooves 47 extending longitudinally in front plate 31 for providing a seal between the closure plate 29 and the front plate 31, when the closure plate 29 is in the closed position against front plate 31 as shown in FIG. 1.

Figure 2:
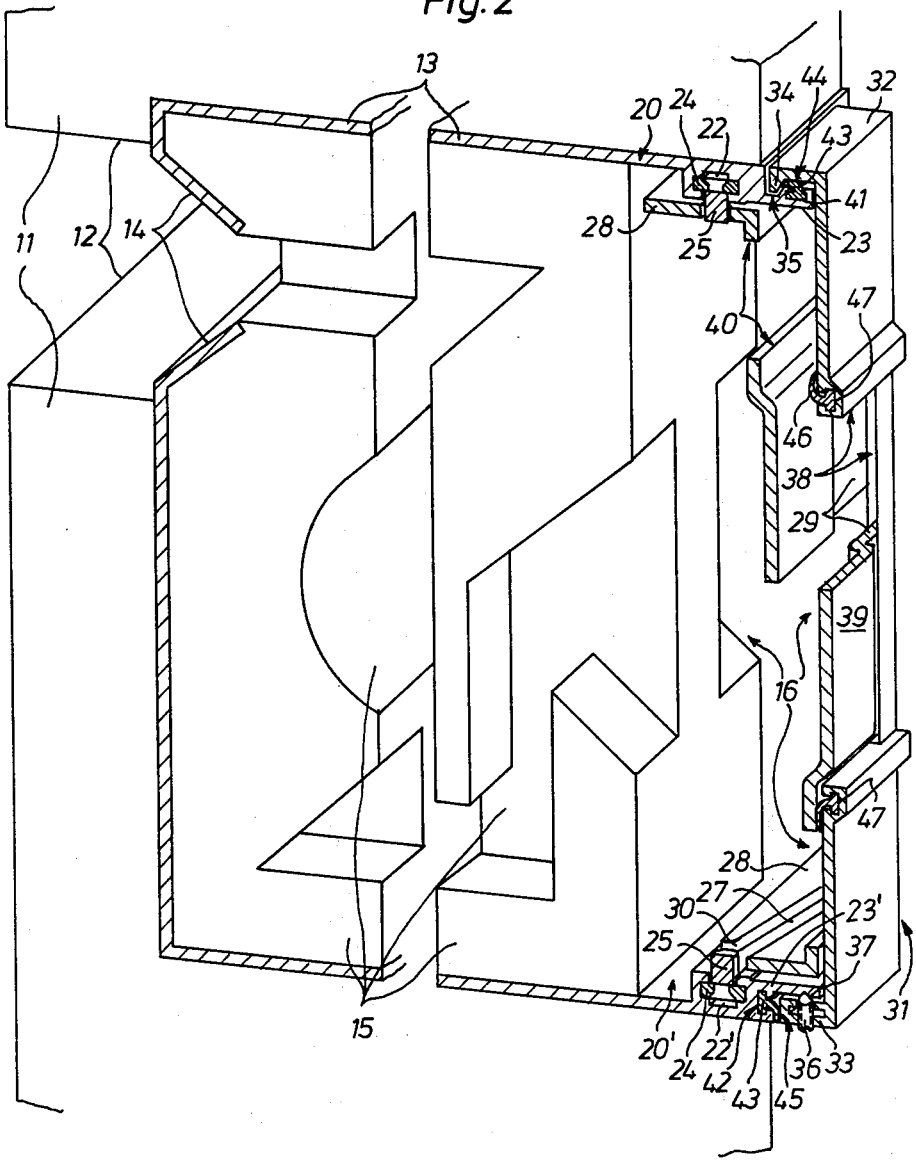
FIG. 2 is a perspective view of a modification of the invention mounted in a window frame in association with a sound-absorbing baffle.
Figure 3:
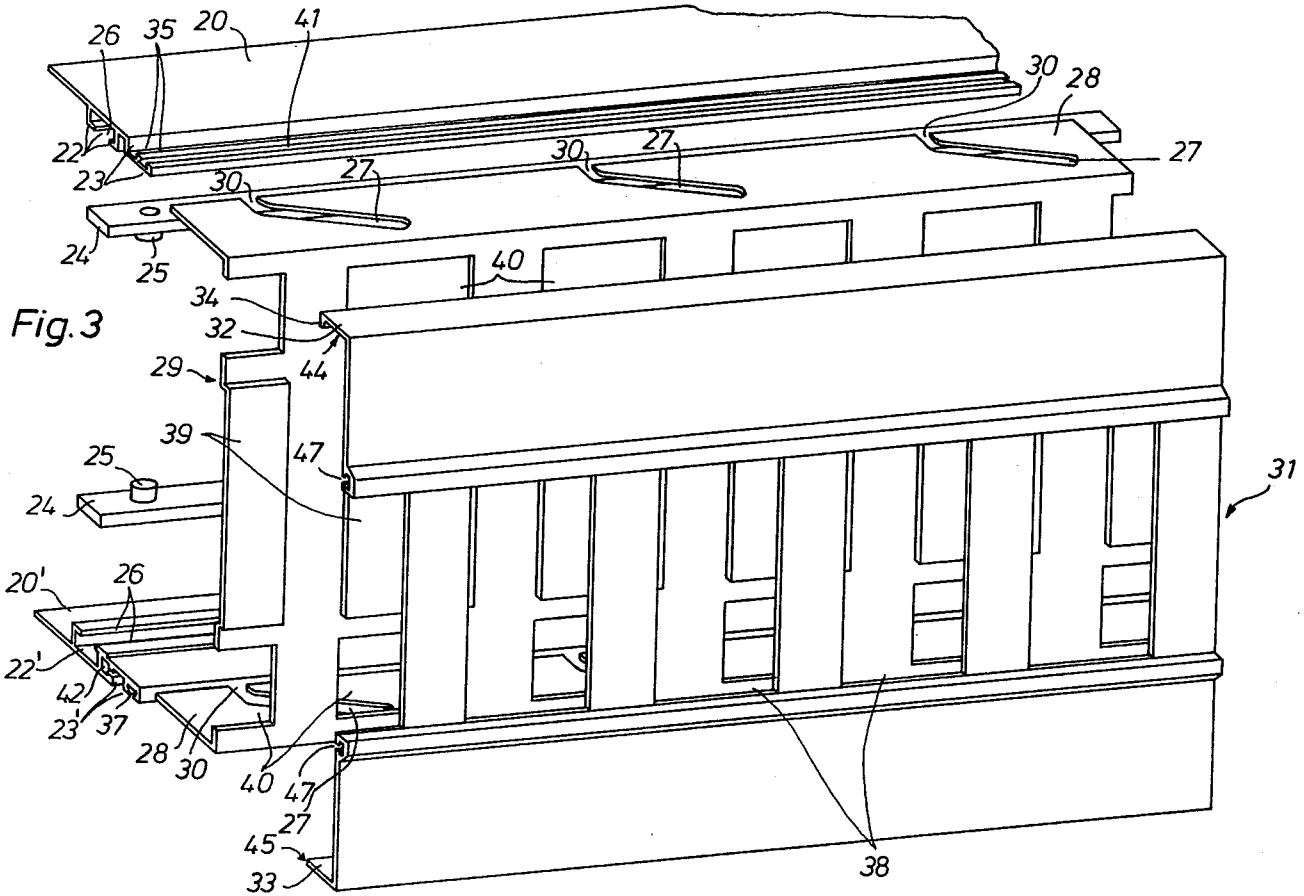
FIG. 3 is an exploded perspective view showing the various elements of the invention.
Figure 4:
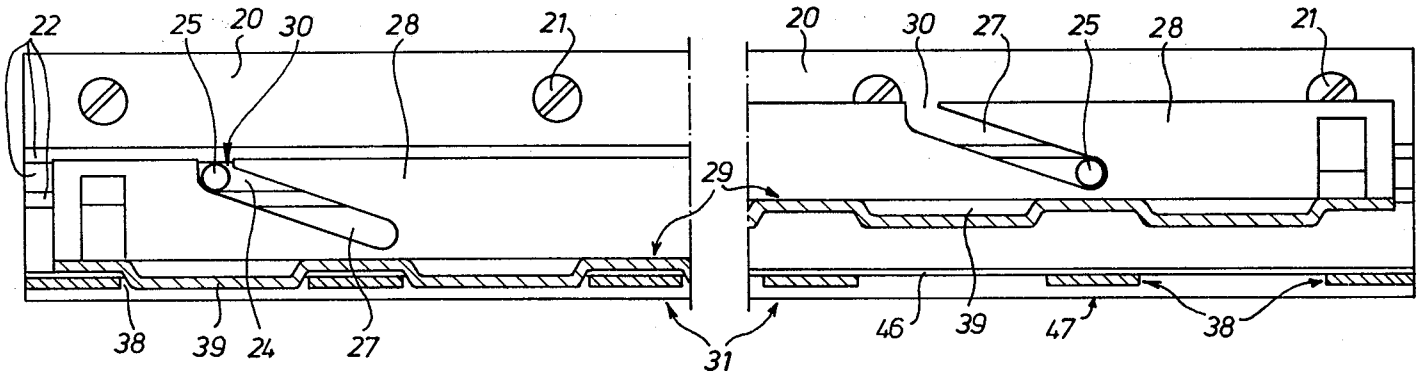
FIG. 4 is a longitudinal sectional view taken along line IV—IV of FIG. 1.

Referring to FIG. 2, there is shown a modification of the present invention as applied to a block-shaped housing 13 placed within an opening 12 in a wall 11. The housing 13 is equipped with vent openings 14 at the outer side. A liner 15 of sound-absorbing material is located within the hollow space of the housing 13 and includes ducts leading from the vent openings 14 to the front or inside of the air vent where the modified air vent device 16 is located. The modified air vent device 16 is identical to air vent device 6 shown in FIG. 1 and the various identical elements are identified with identical reference numerals. The only difference between the two air vent devices shown in FIGS. 1 and 2 is that the upper and lower plates 20 and 20', respectively, of the modified air vent device in FIG. 2 are integral with the housing 13.

The air vents of the present invention may be used anywhere, particularly in rooms where it is desired to exchange air without the need of opening windows.

It is obvious that minor changes may be made in the form and construction of the invention without the parting from the material spirit thereof. It is not, however, desired to confine the invention to the exact form herein shown and described, but it is desired to include all such as properly come within the scope claimed.

The invention, having been thus described, what is claimed as new and desired to secure by Letters Patent is:

1. A vent device for rooms comprising a frame, a detachably mounted front plate with a plurality of apertures, a closure plate transversely to its plane and the plane of the front plate between a closed position wherein the closure plate abuts the front plate to close the apertures and an open position for freeing the apertures of the front plate for free air flow, whereby, the operating device has a push rod, movable within guides extending linearly and parallel to the longitudinal edges of the front plate, the closure plate having a flange extending transversely to the plane of the closure plate and extending over its total length adjacent the push rod, said flanges being provided with a plurality of slanted slots and said push rod being provided with a plurality of pins for engagement with said slots, the free edge of the flange having openings connected to the slots for allowing egress of the pins and removal of the closure plate.

2. A vent device as recited in claim 1, wherein the frame has a horizontal edge bar which extends forwardly and the front plate has a horizontal flange which extends rearwardly in overlapping relationship with the edge bar.

3. A vent device as recited in claim 1, wherein the edge bar has a groove extending longitudinally of the edge bar and the overlapping flange of the front plate has a lip which extends into the groove in a locking relationship.

4. A vent device as recited in claim 3, wherein the frame has a second horizontally and forwardly extending edge bar spaced from the first edge bar and the front plate has a second flange extending rearwardly and horizontally in overlapping relationship with the second edge bar, the second edge bar being provided with a longitudinally extending groove and the second flange being provided with removable fasteners which extend into the groove of the second edge bar.

5. A vent device as recited in claim 4, wherein the first and second edge bars are equipped with additional grooves provided with sealing gaskets which engage the first and second flanges, respectively, in a sealing relationship.

6. An air vent comprising:

(a) a frame;

(b) a front plate having a plurality of spaced apertures;

(c) means for removably mounting the front plate on the frame;

(d) a closure plate behind the front plate movable in a direction transverse to the plane of the closure plate and the front plate between a closed position for blocking the apertures of the front plate and an open position spaced from the front plate for unblocking the apertures of the front plate, said closure plate having a flange extending in a plane which is transverse to the plane of the closure plate and terminating in a free edge, said flange having at least one slanted slot which is at an angle to the plane of the closure plate and an opening at said free edge connected to the slot; and (e) means for moving the closure plate between said closed and open positions including a push rod with a pin extending into the slot, guide means on the frame for guiding the push rod for movement along its longitudinal axis in a direction parallel to the plane of the closure plate, said slot opening permitting egress of the pin from the slot, whereby the closure plate is removable from the frame independently of the means for moving the closure plate.

* * * * *